US009506657B2

(12) United States Patent
Armstrong et al.

(10) Patent No.: US 9,506,657 B2
(45) Date of Patent: Nov. 29, 2016

(54) OVEN PREHEAT BOOST USING COOKTOP LOCKOUT

(71) Applicant: General Electric Company, Schenectady, NY (US)

(72) Inventors: James Lee Armstrong, Louisville, KY (US); Joshua Stephen Wiseman, Elizabethtown, KY (US)

(73) Assignee: Haier U.S. Appliance Solutions, Inc., Wilmington, DE (US)

( * ) Notice: Subject to any disclaimer, the term of this patent is extended or adjusted under 35 U.S.C. 154(b) by 244 days.

(21) Appl. No.: 14/507,996

(22) Filed: Oct. 7, 2014

(65) Prior Publication Data

US 2016/0097543 A1 Apr. 7, 2016

(51) Int. Cl.
*F24C 7/08* (2006.01)
*H05B 3/00* (2006.01)

(52) U.S. Cl.
CPC ..... *F24C 7/082* (2013.01); *F24C 7/08* (2013.01); *F24C 7/085* (2013.01); *F24C 7/087* (2013.01); *H05B 3/0076* (2013.01)

(58) Field of Classification Search
CPC ..... F24C 7/082; F24C 7/08; F24C 7/085; F24C 7/087; H05B 3/0076
USPC ..... 99/337; 126/19 R, 42
See application file for complete search history.

(56) References Cited

U.S. PATENT DOCUMENTS 3,549,862 A * 12/1970 Holtkamp ..... F24C 14/02 219/412
3,648,011 A * 3/1972 Holtkamp ..... F24C 14/02 219/398
3,698,378 A * 10/1972 Rosenberg ..... F24C 3/047 126/299 D
3,736,407 A * 5/1973 Leach ..... G04F 3/06 219/412
3,806,700 A * 4/1974 Gilliom ..... F24C 14/02 219/398
3,875,372 A * 4/1975 Gilliom ..... F24C 15/022 126/197
3,912,904 A * 10/1975 Phifer ..... F24C 15/022 126/197
4,444,095 A * 4/1984 Anetsberger ..... A47J 37/1223 210/184
4,852,544 A * 8/1989 Williams ..... F24C 7/087 126/19 R
4,998,024 A * 3/1991 Kirk ..... G06Q 50/06 307/35
5,981,915 A * 11/1999 Head ..... H05B 6/6476 219/492
7,009,147 B1 * 3/2006 Schulte ..... F24C 7/06 219/400

(Continued)

OTHER PUBLICATIONS

Co-pending U.S. Appl. No. 14/507,987, filed Oct. 7, 2014.

*Primary Examiner* — Sean Michalski
(74) *Attorney, Agent, or Firm* — Dority & Manning, P.A.

(57) ABSTRACT

An oven range appliance is provided with features for locking out one or more cooktop elements of the oven range to boost preheat performance and thereby decrease the time required to preheat the cooking chamber of the oven range. A method for operating an oven range appliance also is provided. The method includes features for locking out one or more cooktop elements of the oven range to boost preheat performance and thereby decrease the time required to preheat the cooking chamber of the oven range.

19 Claims, 5 Drawing Sheets

(56) References Cited

U.S. PATENT DOCUMENTS 7,045,748 B2 5/2006 Blackson et al.
7,122,766 B1 * 10/2006 Main ..... F24C 7/08 126/19 R
7,368,686 B2 5/2008 Etheredge et al.
8,049,142 B2 11/2011 Blackson et al.
8,242,413 B2 * 8/2012 Choi ..... F24C 15/322 126/332
9,386,905 B2 * 7/2016 Lee ..... H04L 12/12
2002/0092842 A1 * 7/2002 Loveless ..... F24C 7/10 219/400
2005/0236392 A1 * 10/2005 Blackson ..... F24C 3/126 219/446.1
2005/0274711 A1 * 12/2005 Boyer ..... F24C 7/087 219/494
2006/0016445 A1 * 1/2006 Cadima ..... F24C 3/124 126/39 BA
2010/0192939 A1 * 8/2010 Parks ..... F23N 1/002 126/39 BA
2010/0286826 A1 * 11/2010 Tsusaka ..... B25J 9/1633 700/254
2011/0148390 A1 * 6/2011 Burt ..... H02J 3/14 323/318
2011/0215091 A1 * 9/2011 Stanger ..... H05B 6/6479 219/682
2012/0017769 A1 * 1/2012 Inoue ..... F24C 7/08 99/331
2012/0055459 A1 * 3/2012 Ley, III ..... A21B 3/04 126/20
2012/0074123 A1 * 3/2012 Hodapp, Jr. ..... F24C 14/02 219/394
2012/0100492 A1 * 4/2012 Hodapp, Jr. ..... F24C 3/126 431/12
2014/0120219 A1 * 5/2014 Ewell, Jr. ..... A47J 27/62 426/231
2016/0097543 A1 * 4/2016 Armstrong ..... F24C 7/082 99/337
2016/0102869 A1 * 4/2016 Johnson ..... F24C 7/088 99/337
2016/0123600 A1 * 5/2016 Phillips ..... F24C 7/082 99/337
2016/0238260 A1 * 8/2016 Kayihan ..... F24C 15/2007

* cited by examiner

FIG. —3—

OVEN PREHEAT BOOST USING COOKTOP LOCKOUT

FIELD OF THE INVENTION

The subject matter of the present disclosure relates generally to an oven appliance and features for preheating an oven appliance.

BACKGROUND OF THE INVENTION

Oven appliances generally include a cabinet that defines one or more cooking chambers for baking or broiling food items therein. Oven appliances also generally include a self-cleaning feature for cleaning the one or more cooking chambers. To heat the cooking chambers for baking or for self-cleaning, oven appliances include one or more heating elements positioned at a top portion, bottom portion, or both of the cooking chambers. Some oven appliances also include a convection heating element and fan for convection cooking cycles. The heating element or elements may be used for various cycles of the oven appliance, such as a preheat cycle, a cooking cycle, or a self-cleaning cycle.

The time required to preheat a typical electric oven appliance to 350° F. generally varies from about nine to about fifteen minutes, depending on the oven size and the oven rack type. The required preheat time may be a nuisance to a user of the oven appliance waiting to cook her food. However, because the power that may be input to an electric oven appliance is limited by the amount of current the appliance can pull from the breaker, adding heating elements or using multiple heating elements at one time generally is not a viable solution. Moreover, in typical electric oven range appliances, the available power is allocated between the heating elements of the cooking chamber of the oven and the cooktop elements of the range. Thus, oven range appliances generally are limited as to additional sources of heat that may be input into the cooking chamber to decrease the time required to preheat the cooking chamber.

Accordingly, an oven range appliance with features for minimizing the preheat time without exceeding the wattage available to the oven range appliance would be useful. Further, a method for operating an oven range appliance to minimize the preheat time without exceeding the wattage available to the oven range appliance would be beneficial.

BRIEF DESCRIPTION OF THE INVENTION

The present invention provides an oven range appliance with features for locking out one or more cooktop elements of the oven range to boost preheat performance and thereby decrease the time required to preheat the cooking chamber of the oven range. A method for operating an oven range appliance also is provided. The method includes features for locking out one or more cooktop elements of the oven range to boost preheat performance and thereby decrease the time required to preheat the cooking chamber of the oven range. Additional aspects and advantages of the invention will be set forth in part in the following description, may be apparent from the description, or may be learned through practice of the invention.

In a first exemplary embodiment, a method for operating an oven range appliance is provided. The oven range appliance includes a cooking chamber configured for receipt of food items for cooking and a cooktop having one or more cooktop elements for heating or cooking food items. The method includes the steps of establishing a cooking chamber temperature set point $T_{pre}$ for the cooking chamber; activating a heating element of the cooking chamber; determining whether a boost preheat mode of the cooking chamber has been chosen and, if so, then activating one or more lockout elements to lockout one or more of the cooktop elements; activating an additional heating element of the cooking chamber; sensing whether the temperature in the cooking chamber has reached at least $T_{pre}$ and, if so, then activating the one or more lockout elements to unlock to the one or more locked out cooktop elements, and initiating a cooking cycle of the cooking chamber.

In a second exemplary embodiment, a method for operating an oven range appliance is provided. The oven range appliance includes a cooking chamber configured for receipt of food items for cooking and a cooktop having one or more cooktop elements for heating or cooking food items. The method includes the steps of establishing a cooking chamber temperature set point $T_{pre}$ for the cooking chamber; activating a heating element of the cooking chamber; determining whether a boost preheat mode of the cooking chamber has been chosen and, if so, then activating one or more lockout elements to lockout one or more of the cooktop elements; counting a time $t_{lock}$; activating an additional heating element of the cooking chamber; determining whether the time $t_{lock}$ has reached at least a threshold time $t_{thr}$ and, if so, then activating the one or more lockout element to unlock to the one or more locked out cooktop elements.

In a third exemplary embodiment, an oven range appliance is provided. The oven range appliance includes a cabinet defining a cooking chamber configured for receipt of food items for cooking. The cooking chamber comprises a plurality of heating elements configured to heat the cooking chamber. The oven range appliance also includes a cooktop having one or more cooktop elements configured for heating or cooking food items; one or more lockout elements configured to lock out the one or more cooktop elements from a power supply; and a controller in operative communication with the heating elements of the cooking chamber, the one or more cooktop elements, and the one or more lockout elements. The controller is configured for establishing a cooking chamber temperature set point $T_{pre}$ for the cooking chamber; activating one of the plurality of heating elements; determining whether a boost preheat mode of the cooking chamber has been chosen and, if so, then activating one or more of the lockout elements to lockout one or more of the cooktop elements; activating an additional heating element; sensing whether the temperature in the cooking chamber has reached at least $T_{pre}$ and, if so, then activating the one or more lockout elements to unlock to the one or more locked out cooktop elements, and initiating a cooking cycle of the cooking chamber.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Use of the same reference numerals in different figures denotes the same or similar features.

DETAILED DESCRIPTION OF THE INVENTION

Figure 1:
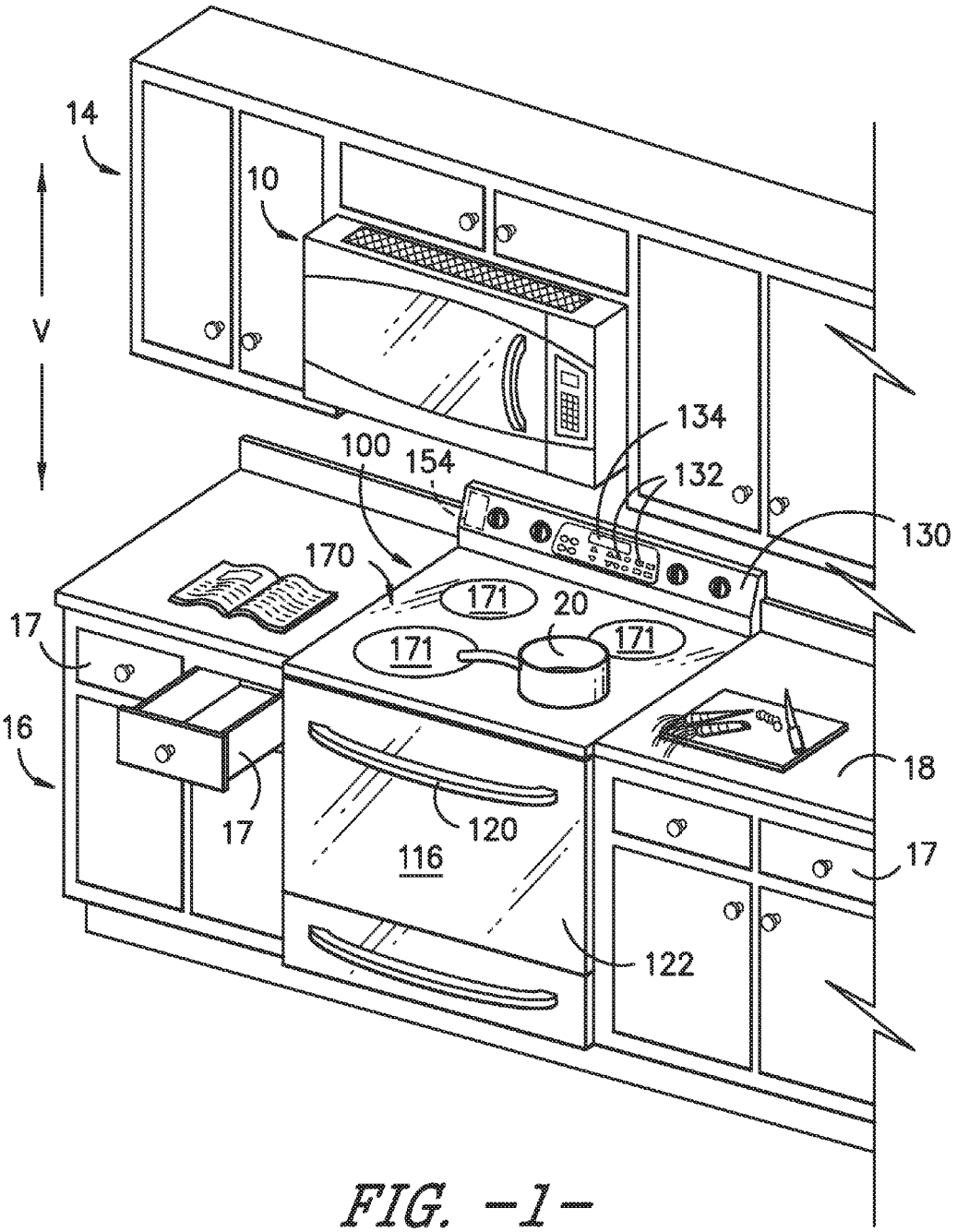
FIG. 1 provides a perspective view of an oven range appliance received within a set of kitchen cabinets according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of an oven range appliance 100 received within a set of kitchen cabinets. Oven range appliance 100 is provided by way of example only and is not intended to limit the present subject matter in any aspect. Thus, the present subject matter may be used with other oven appliance configurations, e.g., that define one or more interior cavities for the receipt of food and/or that are wall mounted. Further, the present subject matter may be used in any other suitable appliance.

FIG. 1 also illustrates a microwave appliance 10, commonly referred to as an over-the-range microwave, mounted to an upper set of kitchen cabinets 14 above an oven range appliance 100, e.g., along a vertical direction V. Upper set of kitchen cabinets 14 is positioned above a base set of kitchen cabinets 16, e.g., along the vertical direction V. Base set of kitchen cabinets 16 includes countertops 18 and drawers 17. Oven range appliance 100 is received within base set of kitchen cabinets 16 below microwave appliance 10 such that a cooking surface or cooktop 170 of oven range appliance 12 is positioned, e.g., directly below microwave appliance 10 along the vertical direction V. Microwave appliance 10 can include features such as an air handler or fan (not shown) that can draw cooking vapors and/or smoke away from cooktop 170 and out of the kitchen containing microwave and oven range appliances 10 and 100.

Cooktop 170 of oven range 100 includes heated portions 171 that may be heated by cooktop heating elements (FIG. 3), e.g., electrical resistive heating elements, gas burners, induction heating elements, and/or any other suitable heating element or combination of heating elements. In an exemplary embodiment of oven range 100 described herein, cooktop 170 includes first cooktop element 172, second cooktop element 174, third cooktop element 176, and fourth cooktop element 178. In alternative embodiments, fewer or more than four cooktop elements may be provided with cooktop 170. Cooking utensils, such as cooking utensil 20, may be placed on heated portions 171 to cook or heat food items.

Figure 2:
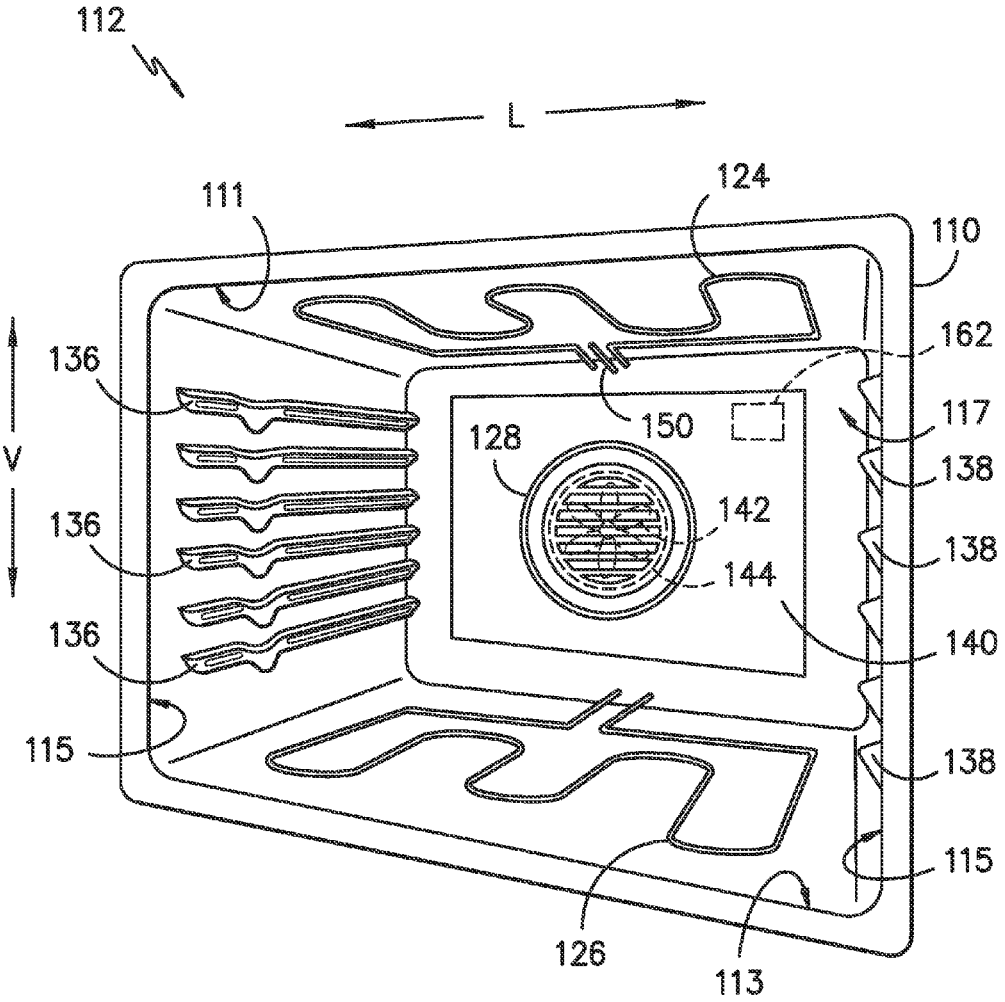
FIG. 2 provides a perspective view of an exemplary embodiment of the cooking chamber of the oven appliance of FIG. 1.

Referring to FIG. 2, for an exemplary embodiment of oven range 100, cooking chamber 112 is defined by a top wall 111, a bottom wall 113, opposing side walls 115, and a back wall 117. A baking rack (not shown) for the receipt of food items or utensils containing food items may be slidably received onto embossed ribs or sliding rails 136, 138 such that the rack may be conveniently moved into and out of cooking chamber 112 when door 116 is open. A plurality of heating elements, including a heating element at the top, bottom, or both of cooking chamber 112 provides heat from an energy source or power supply 162 to cooking chamber 112 for cooking. Such heating element(s) can be, e.g., gas, electric, microwave, or a combination thereof. For example, in the embodiment shown in FIG. 2, cooking chamber 112 includes an electric broil heating element 124 and an electric bake heating element 126, which are connected to power supply 162. To boost preheat performance, as further described below, cooking chamber 112 may also include an boost heating element 128.

The plurality of heating elements also includes a convection heating element 144, which is positioned with a convection fan 142 behind a protective panel 140 adjacent back wall 117. Fan 142 may provide air movement in upper cooking chamber 112 during, e.g., convection modes of oven appliance 100. Other configurations of convection fan 142 and convection heating element 144 may be used as well.

Further, a temperature sensor 150 may be located adjacent top wall 111. In alternative embodiments, temperature sensor 150 may be positioned in another location within cooking chamber 112. In still other embodiments, oven range 100 may include more than one temperature sensor within cooking chamber 112. Temperature sensor 150 may be a resistive temperature device (RTD) or any other suitable sensor.

Referring back to FIG. 1, oven range appliance 100 includes a control panel 130 having a display 134 and a variety of controls 132. Using controls 132, a user of oven range 100 may select various options for the operation of oven range 100 including, e.g., temperature, time, and/or various cooking and cleaning cycles of cooking chamber 112, as well as various settings for cooktop 170 such as the power level of cooktop elements 172, 174, 176, 178. Information as to, e.g., the operation of oven range 100 may be shown on display 134, which can be a liquid crystal display, a dot matrix display, a series of seven-segment displays, etc.

Operation of oven range appliance 100 can be regulated by a controller 154 that is operatively coupled, i.e., in communication with, control panel 130, oven heating elements 124, 126, 128, 144, fan 142, cooktop elements 172, 174, 176, 178, and/or other components of oven range 100. For example, in response to user manipulation of the control panel 130, controller 154 can operate the oven heating element(s) and/or the cooktop heating element(s). As a further example, controller 154 can receive measurements from temperature sensor 150 placed in upper cooking chamber 112 and, e.g., provide a temperature indication to the user with display 134. Controller 154 can also be provided with other features as will be further described herein.

Controller 154 may include a memory and one or more processing devices such as microprocessors, CPUs, or the like, such as general or special purpose microprocessors operable to execute programming instructions or micro-control code associated with operation of oven range appliance 100. The memory may represent random access memory such as DRAM or read only memory such as ROM or FLASH. In one embodiment, the processor executes programming instructions stored in memory. The memory may be a separate component from the processor or may be included onboard within the processor.

Controller 154 may be positioned in a variety of locations throughout oven range 100. In the illustrated embodiment, controller 154 is located within control panel 130. In other embodiments, controller 154 may be located at any other appropriate location with respect to oven range 100. In the embodiment shown in FIG. 1, input/output ("I/O") signals are routed between controller 154 and various operational components of oven range 100 such as oven heating elements 124, 126, 128, 144, fan 142, controls 132, display 134, temperature sensor 150, cooktop elements 172, 174, 176, 178, alarms, and/or other components as may be provided. Such other components may include, e.g., lockout elements 182, 184, 186, 188 described below. In one embodiment, the control panel 130 may represent a general purpose I/O ("GPIO") device or functional block.

Although shown with touch type controls 132, it should be understood that controls 132 and the configuration of oven range appliance 100 shown in FIG. 1 is provided by way of example only. More specifically, control panel 130 may include various input components, such as one or more of a variety of electrical, mechanical, or electro-mechanical input devices including rotary dials, push buttons, and touch pads. Panel 130 may include other display components, such as a digital or analog display device designed to provide operational feedback to a user. Panel 130 may be in communication with controller 154 via one or more signal lines or shared communication busses.

Figure 3:
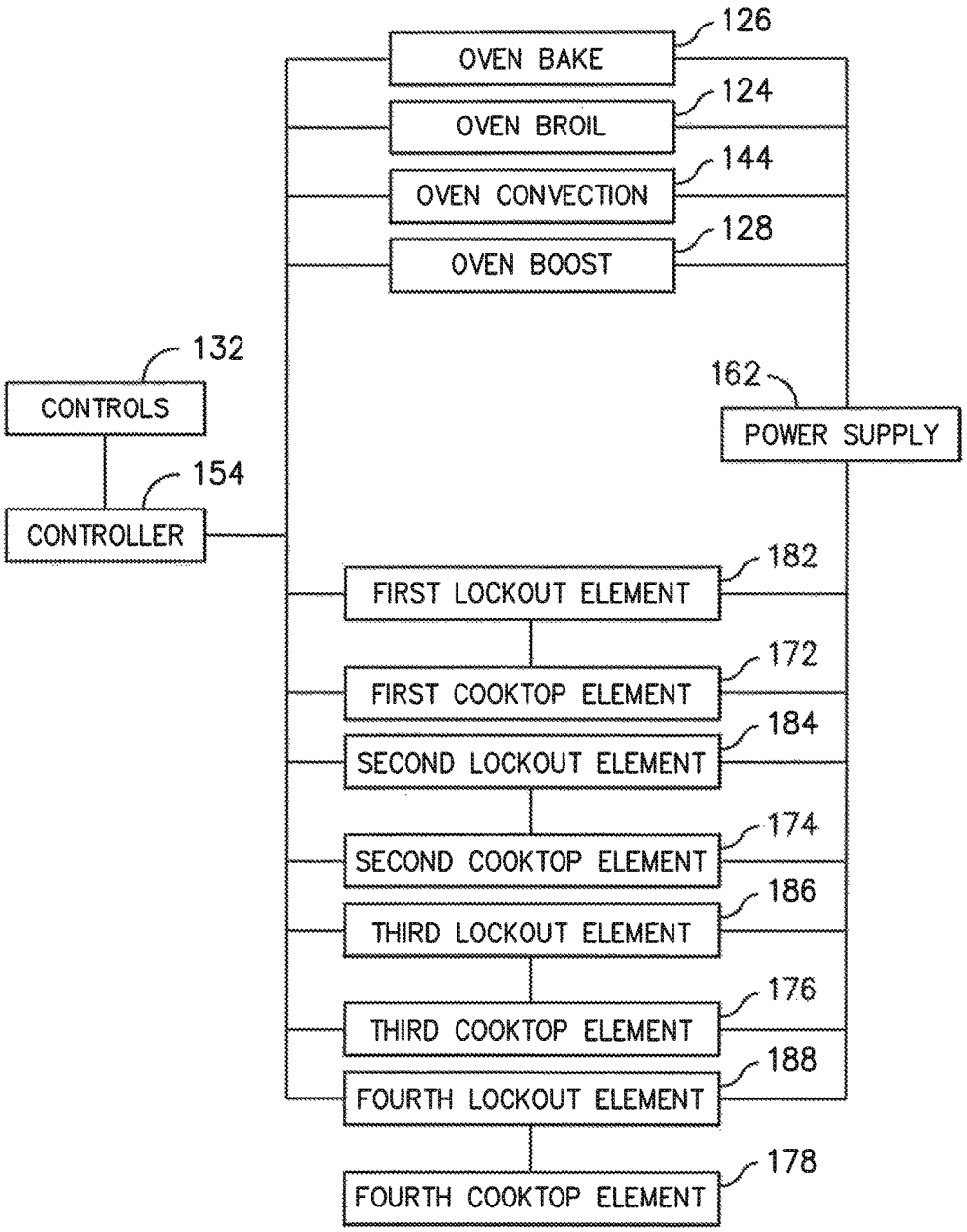
FIG. 3 provides a schematic diagram of an exemplary embodiment of a controller of an exemplary oven appliance of the present subject matter in operative communication with various components of the oven appliance.

Referring now to FIG. 3, in one exemplary embodiment, controller 154 may be in operative communication with various components of oven range appliance 100 as shown in the schematic diagram. As previously described, controller 154 is in communication with controls 132, oven heating elements 124, 126, 128, 144, and cooktop elements 172, 174, 176, 178. Thus, by manipulating controls 132, a user can select, e.g., a cooking mode of cooking chamber 112, a cooking temperature of cooking chamber 112, a cleaning cycle of cooking chamber 112, and/or a power setting of first cooktop element 172, second cooktop element 174, third cooktop element 176, and/or fourth cooktop element 178. The selection of a cooking mode, such as, e.g., bake, broil, or convect, and a cooking temperature for cooking chamber 112 by the user may initiate a preheat cycle of the cooking chamber. During a preheat cycle, the air and surfaces of the cooking chamber are brought up to temperature for a cooking cycle at the selected temperature in the selected cooking mode.

The preheat cycle may require more time than a user has or is willing to wait for the cooking chamber to come up to temperature. To reduce the time required for the preheat cycle, oven range appliance 100 may include a boost preheat mode that may be chosen by the user. When the user chooses the boost preheat mode, one or more heating elements may be used in addition to the heating element typically employed to preheat the cooking chamber, and thereby input more heat to the cooking chamber during the preheat cycle. However, for oven ranges with, e.g., electric heating and cooktop elements, the amount of power available to run additional heating elements is limited by the current the appliance can pull from the breaker. Additionally, the amount of available power is typically allocated between the cooking chamber and the cooktop elements. For example, a oven range is limited to approximately 40 amps on a 240 volt breaker, thus having available about 9600 watts to power the oven range. Usually, the power available to the heating elements of the cooking chamber of the oven is approximately 4000 watts, with about 5600 watts available to power the cooktop elements.

Thus, to use the power allocated to the cooktop elements to power additional heating elements for a preheat cycle of the oven cooking chamber, one or more cooktop elements 172, 174, 176, 178 may be locked out. That is, the cooktop elements may be disconnected from their power supply such that the power otherwise available for the cooktop elements may be used to boost the preheat performance of the oven cooking chamber, as further described below, without, e.g., tripping the breaker. If the user does not choose the boost preheat mode, a normal preheat algorithm may be executed, i.e., a preheat cycle without features for boosting the preheat performance of the cooking chamber is executed.

As shown in FIG. 3, to lockout the cooktop elements, a lockout element may be interposed between controller 154, power supply 162, and each of cooktop heating elements 172, 174, 176, 178. Thus, a first lockout element 182 may be interposed between controller 154, power supply 162, and first cooktop element 172; a second lockout element 184 may be interposed between controller 154, power supply 162, and second cooktop element 174; a third lockout element 186 may be interposed between controller 154, power supply 162, and third cooktop element 176; and a fourth lockout element 188 may be interposed between controller 154, power supply 162, and fourth cooktop element 178. Lockout elements 182, 184, 186, 188 may be, e.g., a relay or the like that, when closed, allow operative communication between controller 154 and the cooktop elements and provide power to the cooktop elements but, when open, disconnect controller 154 and power supply 162 from the cooktop elements. Different numbers and configurations of lockout elements may be used as well. For example, one lockout element may be interposed between controller 154, power supply 162, and all of cooktop elements 172, 174, 176, 178 such that all of the cooktop elements may be locked out or unlocked by the activation of one lockout element.

Figure 4:
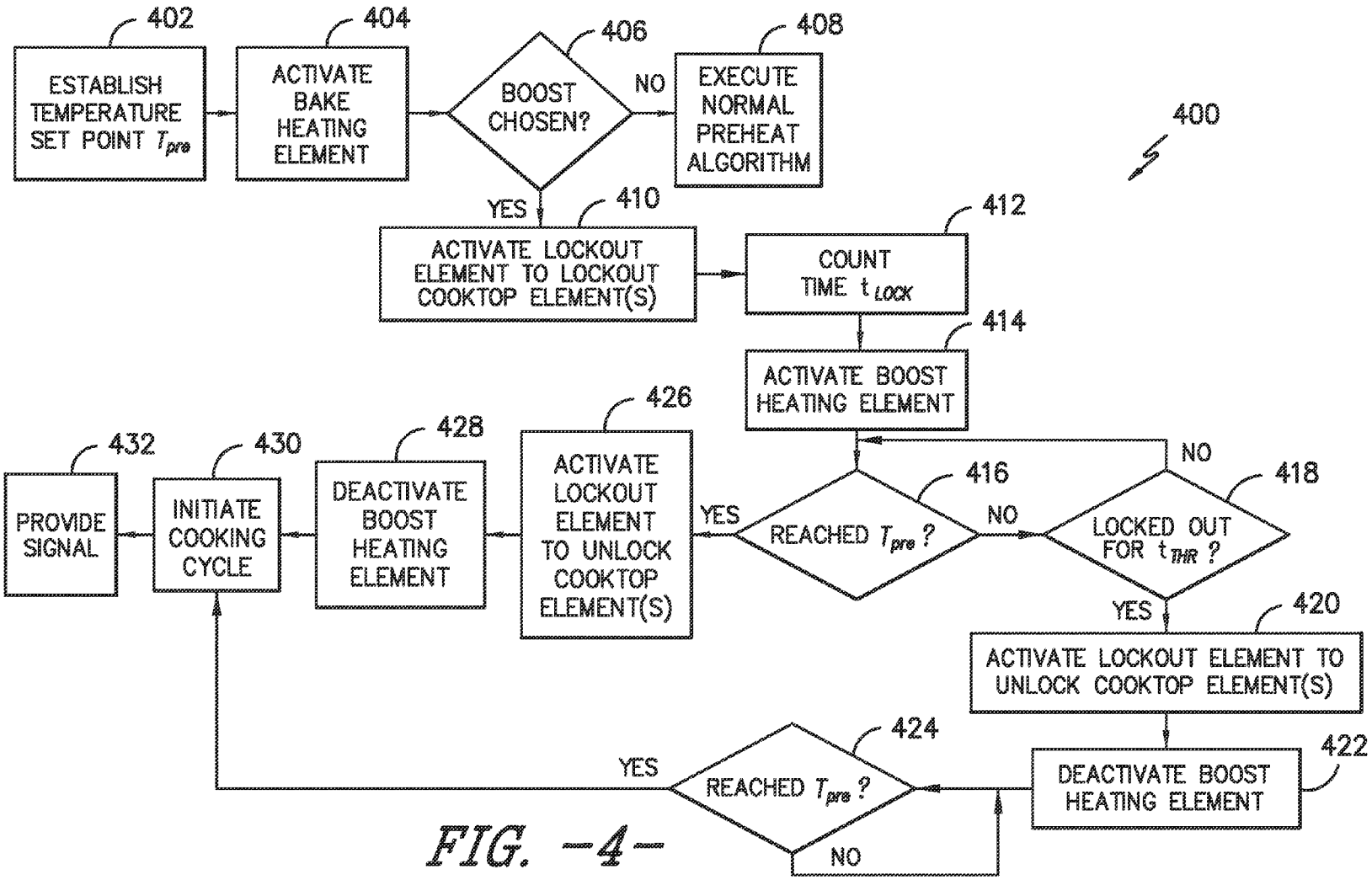
FIG. 4 provides a chart illustrating a method of operating an oven appliance in accordance with one exemplary embodiment of the present subject matter.

FIG. 4 provides a chart illustrating an exemplary method 400 of operating oven range appliance 100. Although described below as performed by controller 154, method 400 may be performed in whole or in part by controller 154 or any other suitable device or devices. At step 402, a cooking chamber temperature set point $T_{pre}$ for a preheat cycle is established for cooking chamber 112. The temperature set point $T_{pre}$ may be determined using the cooking temperature selected by the user of the oven appliance, e.g., the temperature set point $T_{pre}$ may be the cooking temperature selected by the user or a temperature over or under the selected cooking temperature. In alternative embodiments, temperature set point $T_{pre}$ may be a predetermined temperature that is used for each preheat cycle, regardless of the cooking temperature selected by the user. Other values of and methods for determining the temperature set point $T_{pre}$ may be used as well.

After establishing temperature set point $T_{pre}$, at step 404, bake heating element 126 of cooking chamber 112 is activated, i.e., powered on to heat the cooking chamber and, thus, begin a preheat cycle. In other embodiments, broil heating element 124 or convection heating element 144 may be activated to heat cooking chamber 112 during the preheat cycle, and convection fan 142 may also be activated to circulate heated air through the chamber and thereby assist in preheating the air and surfaces of cooking chamber 112.

At step 406, controller 154 determines whether a boost preheat mode has been chosen. For example, one of the plurality of controls 132 may be, e.g., a button, knob, or the like labeled "Preheat Boost" on control panel 130. When manipulated, the control 132 may signal to controller 154 that the user desires to boost the preheat performance of cooking chamber 112, i.e., that the user desires to shorten the time required to preheat cooking chamber 112. Other ways of selecting a boost preheat mode and determining whether a boost preheat mode has been selected may be used as well.

If controller 154 determines the boost preheat mode has not been selected, at step 408, controller 154 executes a normal preheat algorithm, i.e., the preheat cycle proceeds without any input configured to shorten the preheat cycle. However, if the boost preheat mode has been selected, method 400 proceeds to step 410. At step 410, one or more lockout elements 182, 184, 186, 188 are activated to lockout one or more of cooktop elements 172, 174, 176, 178. That is, one or more lockout elements 182, 184, 186, 188 are activated to disconnect one or more of cooktop elements 172, 174, 176, 178 from power supply 162 by, e.g., opening a relay or the like. As an example, to reduce the preheat time of cooking chamber 112, at step 410 lockout elements 182 and 184 are activated to lockout cooktop elements 172 and 174 such that the power that would be available to activate cooktop elements 172, 174 is available to power heating elements in addition to bake heating element 126 to boost the heat input to cooking chamber 112.

At step 412, controller 154 may begin counting a time $t_{lock}$ that the cooktop element or elements are locked out. Then, at step 414, controller 154 activates boost heating element 128 of cooking chamber 112 to boost the heat input to cooking chamber 112 as described. Thereafter, at step 416, controller 154 monitors the temperature of cooking chamber 112 to determine whether the cooking chamber has reached at least the set point temperature $T_{pre}$. Controller 154 may monitor the temperature of cooking chamber 112 using, e.g., temperature sensor 150 located cooking chamber 112. If the temperature of cooking chamber 112 has not reached at least temperature $T_{pre}$, controller 154 may determine at step 418 whether the time $t_{lock}$ has reached at least a threshold time $t_{thr}$. Time $t_{thr}$ may be, e.g., a time programmed into controller 154 during the manufacture of oven appliance 100 or a time selected by a user of oven 100. If time $t_{lock}$ has not reached at least time $t_{thr}$, as shown in FIG. 4, controller 154 continues to monitor the temperature of cooking chamber 112 and count the time $t_{lock}$ the cooktop element or elements have been locked out.

However, if at step 418 the time $t_{lock}$ has reached at least time $t_{thr}$, method 400 includes step 420 of activating the lockout element(s) of the locked out cooktop element(s) to unlock the cooktop element(s). Continuing with the above example, if cooktop elements 172 and 174 were locked out at step 410 by activating lockout elements 182, 184, when cooktop elements 172, 174 have been locked out for at least time $t_{thr}$, lockout elements 182, 184 are activated at step 420 to unlock cooktop elements 172, 174. That is, if lockout elements 182, 184 are, e.g., relays, the relays are closed at step 420 to reconnect cooktop elements 172, 174 to controller 154 and power supply 162. Accordingly, in some embodiments, the cooktop elements may be locked out for only a period of time $t_{thr}$ during a given preheat cycle. In other embodiments, steps 418 through 424 of method 400 may be omitted such that the one or more cooktop elements are locked out until the temperature within cooking chamber 112 reaches at least the temperature set point $T_{pre}$.

Then at step 422, boost heating element 128 of cooking chamber 112 is deactivated. At step 424, controller 154 determines whether the temperature in cooking chamber 112 has reached at least the set point temperature $T_{pre}$. If not, controller 154 continues to monitor the temperature of the cooking chamber 112 using, e.g., temperature sensor 150. If the temperature has reached at least $T_{pre}$, method 400 continues to step 430 described below.

If at step 416 the temperature of cooking chamber 112 has reached at least temperature $T_{pre}$, method 400 includes step 424 of activating the lockout element(s) of the locked out cooktop element(s) to unlock the locked out cooktop element(s). Continuing with the previous example, where the locked out cooktop elements are cooktop elements 172, 174, when cooking chamber 112 reaches at least temperature $T_{pre}$, lockout elements 182, 184 are activated to unlock cooktop elements 172, 174. As described, by unlocking cooktop elements 172, 174, lockout element 182, 184 place cooktop elements 172, 174 in communication with controller 154 and power supply 162 such that cooktop elements 172, 174 may be activated by controller 154. After the locked out cooktop element(s) are unlocked, boost heating element 128 is deactivated at step 428.

When cooking chamber 112 reaches at least temperature $T_{pre}$, the cooking chamber is preheated. As a result, at step 430, the cooking cycle is initiated. At step 432, a signal may be provided to a user of oven range appliance 100 that cooking chamber 112 has reached temperature set point $T_{pre}$ or, alternatively, that the preheat cycle is complete. The signal may be, e.g., any audible and/or visual signal that indicates to the user that the selected cooking chamber has reached at least temperature set point $T_{pre}$. By way of example, the signal may be a notification displayed on control panel 130 of the appliance, an LED light, a buzzer, and/or any other appropriate visual and/or audible signal.

Figure 5:
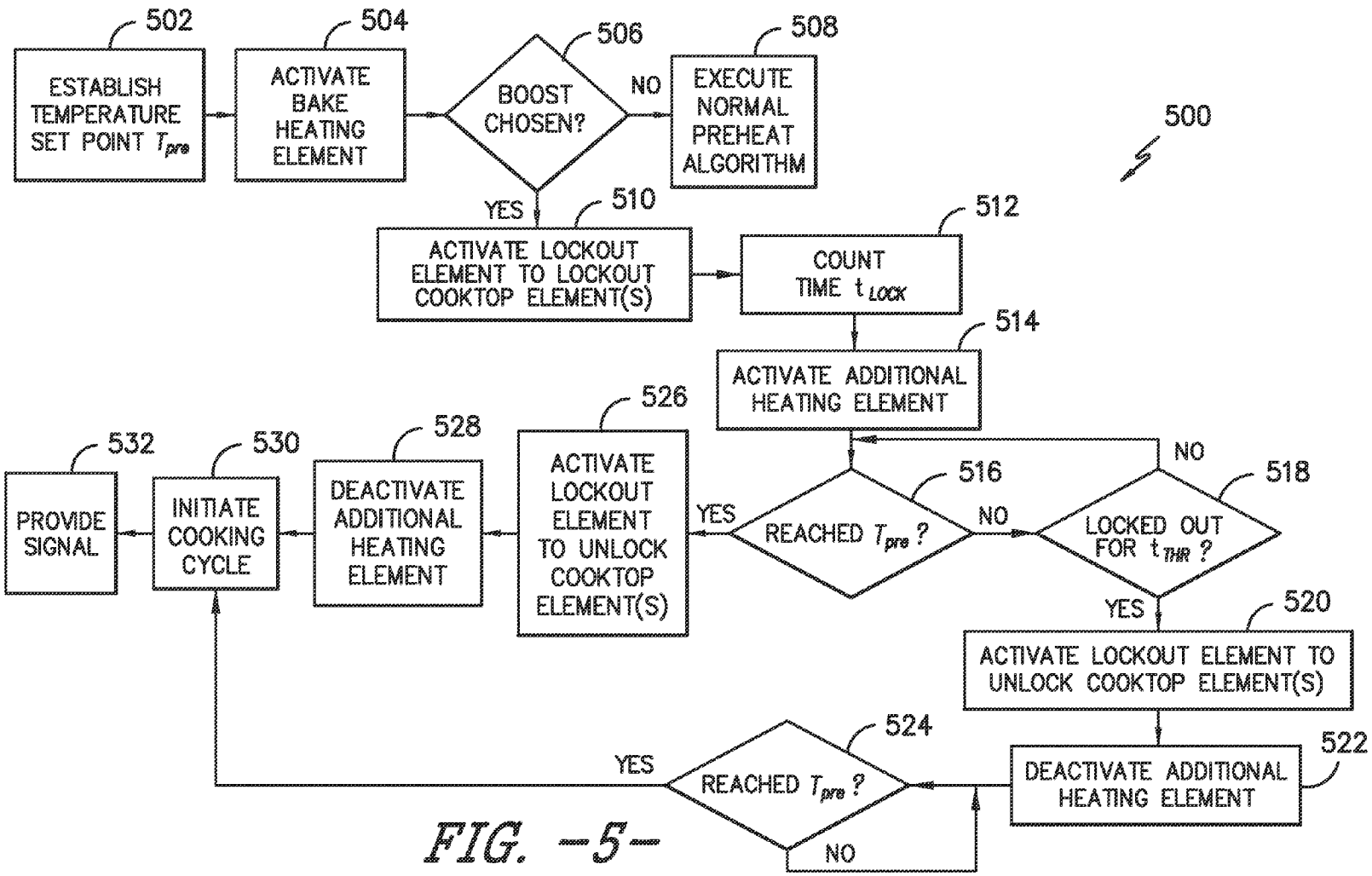
FIG. 5 provides a chart illustrating a method of operating an oven appliance in accordance with another exemplary embodiment of the present subject matter.

FIG. 5 provides a chart illustrating another exemplary method 500 of operating oven range appliance 100. Although described below as performed by controller 154, method 500 may be performed in whole or in part by controller 154 or any other suitable device or devices. At step 502, a cooking chamber temperature set point $T_{pre}$ for a preheat cycle is established for cooking chamber 112. The temperature set point $T_{pre}$ may be determined using the cooking temperature selected by the user of the oven appliance, e.g., the temperature set point $T_{pre}$ may be the cooking temperature selected by the user or a temperature over or under the selected cooking temperature. In alternative embodiments, temperature set point $T_{pre}$ may be a predetermined temperature that is used for each preheat cycle, regardless of the cooking temperature selected by the user. Other values of and methods for determining the temperature set point $T_{pre}$ may be used as well.

After establishing temperature set point $T_{pre}$, at step 504, bake heating element 126 of cooking chamber 112 is activated, i.e., powered on to heat the cooking chamber and, thus, begin a preheat cycle. In other embodiments, broil heating element 124 or convection heating element 144 may be activated to heat cooking chamber 112 during the preheat cycle, and convection fan 142 may also be activated to assist in preheating the air and surfaces of cooking chamber 112.

At step 506, controller 154 determines whether a preheat boost mode has been selected. For example, one of the plurality of controls 132 may be, e.g., a button, knob, or the like labeled "Preheat Boost" on control panel 130. When manipulated, the control 132 may signal to controller 154 that the user desires to boost the preheat performance of cooking chamber 112, i.e., that the user desires to shorten the time required to preheat cooking chamber 112. Other ways of selecting a preheat boost mode and determining whether a preheat boost mode has been selected may be used as well.

If controller 154 determines the preheat boost mode has not been selected, at step 508, controller 154 executes a normal preheat algorithm, i.e., the preheat cycle proceeds without any input configured to shorten the preheat cycle. However, if the preheat boost mode has been selected, method 400 proceeds to step 510. At step 510, one or more lockout elements 182, 184, 186, 188 are activated to lockout one or more of cooktop elements 172, 174, 176, 178. That is, one or more lockout elements 182, 184, 186, 188 are activated to disconnect one or more of cooktop elements 172, 174, 176, 178 from power supply 162 by, e.g., opening a relay or the like. As an example, to reduce the preheat time of cooking chamber 112, at step 510 lockout elements 182 and 184 are activated to lockout cooktop elements 172 and 174 such that the power that would be available to activate cooktop elements 172, 174 is available to power heating elements in addition to bake heating element 126 to boost the heat input to cooking chamber 112.

At step 512, controller 154 may begin counting a time $t_{lock}$ that the cooktop element or elements are locked out. Then, at step 514, controller 154 activates an additional heating element of cooking chamber 112 to boost the heat input to cooking chamber 112 as described. Thus, if at step 504 bake heating element 126 was activated to heat cooking chamber 112, at step 514 broil heating element 124 and/or convection heating element 144 is activated to boost the heat input into cooking chamber 112 and thereby reduce the time required to preheat cooking chamber 112. In alternative embodiments, the additional heating element may be boost heating element 128.

Thereafter, at step 516, controller 154 monitors the temperature of cooking chamber 112 to determine whether the cooking chamber has reached at least the set point temperature $T_{pre}$. Controller 154 may monitor the temperature of cooking chamber 112 using, e.g., temperature sensor 150 located cooking chamber 112. If the temperature of cooking chamber 112 has not reached at least temperature $T_{pre}$, controller 154 may determine at step 518 whether the time $t_{lock}$ has reached at least a threshold time $t_{thr}$. Time $t_{thr}$ may be, e.g., a time programmed into controller 154 during the manufacture of oven appliance 100 or a time selected by a user of oven 100. If time $t_{lock}$ has not reached at least time $t_{thr}$, as shown in FIG. 5, controller 154 continues to monitor the temperature of cooking chamber 112 and count the time $t_{lock}$ the cooktop element or elements have been locked out.

Otherwise, if at step 518 the time $t_{lock}$ has reached at least time $t_{thr}$, method 400 includes step 520 of activating the lockout element(s) of the locked out cooktop element(s) to unlock the cooktop element(s). Continuing with the above example, if cooktop elements 172 and 174 were locked out at step 510 by activating lockout elements 182, 184, when cooktop elements 172, 174 have been locked out for at least time $t_{thr}$, lockout elements 182, 184 are activated at step 520 to unlock cooktop elements 172, 174. That is, if lockout elements 182, 184 are, e.g., relays, the relays are closed at step 520 to reconnect cooktop elements 172, 174 to controller 154 and power supply 162. Thus, in some embodiments, the cooktop elements may be locked out for only a period of time $t_{thr}$ during a given preheat cycle. In other embodiments, steps 518 through 524 of method 500 may be omitted such that the one or more cooktop elements are locked out until the temperature within cooking chamber 112 reaches at least the temperature set point $T_{pre}$.

Then at step 522, boost heating element 128 of cooking chamber 112 is deactivated. At step 524, controller 154 determines whether the temperature in cooking chamber 112 has reached at least the set point temperature $T_{pre}$. If not, controller 154 continues to monitor the temperature of the cooking chamber 112 using, e.g., temperature sensor 150. If the temperature has reached at least $T_{pre}$, method 400 continues to step 530 described below.

If at step 516 the temperature of cooking chamber 112 has reached at least temperature $T_{pre}$, method 500 includes step 524 of activating the lockout element(s) of the locked out cooktop element(s) to unlock the locked out cooktop element(s). Continuing with the previous example, where the locked out cooktop elements are cooktop elements 172, 174, when cooking chamber 112 reaches at least temperature $T_{pre}$, lockout elements 182, 184 are activated to unlock cooktop elements 172, 174. As described, by unlocking cooktop elements 172, 174, lockout element 182, 184 place cooktop elements 172, 174 in communication with controller 154 and power supply 162 such that cooktop elements 172, 174 may be activated by controller 154. After the locked out cooktop element(s) are unlocked, boost heating element 128 is deactivated at step 528.

When cooking chamber 112 reaches at least temperature $T_{pre}$, the cooking chamber is preheated. As a result, at step 530, the cooking cycle is initiated. At step 532, a signal may be provided to a user of oven range appliance 100 that cooking chamber 112 has reached temperature set point $T_{pre}$ or, alternatively, that the preheat cycle is complete. The signal may be, e.g., any audible and/or visual signal that indicates to the user that the selected cooking chamber has reached at least temperature set point $T_{pre}$. By way of example, the signal may be a notification displayed on control panel 130 of the appliance, an LED light, a buzzer, and/or any other appropriate visual and/or audible signal.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A method for operating an oven range appliance, the oven range appliance including a cooking chamber configured for receipt of food items for cooking, the oven range appliance also including a cooktop having one or more cooktop elements for heating or cooking food items, the method comprising the steps of:

establishing a cooking chamber temperature set point $T_{pre}$ for the cooking chamber;

activating a heating element of the cooking chamber;

determining whether a boost preheat mode of the cooking chamber has been chosen and, if so, then activating one or more lockout elements to lockout one or more of the cooktop elements;

activating an additional heating element of the cooking chamber;

sensing whether the temperature in the cooking chamber has reached at least $T_{pre}$ and, if so, then activating the one or more lockout elements to unlock to the one or more locked out cooktop elements, and initiating a cooking cycle of the cooking chamber.

2. The method of claim 1, further comprising the step of providing a signal to a user of the oven range appliance, during the step of initiating the cooking cycle, that the cooking chamber temperature has reached at least $T_{pre}$.

3. The method of claim 1, further comprising the step of counting a time $t_{lock}$ during the step of activating the one or more lockout elements.

4. The method of claim 3, wherein if the temperature in the cooking chamber has not reached at least $T_{pre}$, the method further comprises the steps of:

determining whether the time $t_{lock}$ has reached at least a threshold time $t_{thr}$ and, if so, then activating the one or more lockout elements to unlock the one or more locked out cooktop elements;

sensing whether the temperature in the cooking chamber has reached at least $T_{pre}$ and, if so, then initiating the cooking cycle of the cooking chamber.

5. The method of claim 1, further comprising the step of executing a normal preheat algorithm if the boost preheat mode has not been chosen.

6. The method of claim 1, wherein the step of activating the one or more lockout elements to lockout one or more cooktop elements comprises opening one or more relays between the one or more cooktop elements and a power supply.

7. A method for operating an oven range appliance, the oven range appliance including a cooking chamber configured for receipt of food items for cooking, the oven range appliance also including a cooktop having one or more cooktop elements for heating or cooking food items, the method comprising the steps of:

establishing a cooking chamber temperature set point $T_{pre}$ for the cooking chamber;

activating a heating element of the cooking chamber;

determining whether a boost preheat mode of the cooking chamber has been chosen and, if so, then activating one or more lockout elements to lockout one or more of the cooktop elements;

counting a time $t_{lock}$;

activating an additional heating element of the cooking chamber;

determining whether the time $t_{lock}$ has reached at least a threshold time $t_{thr}$ and, if so, then activating the one or more lockout element to unlock to the one or more locked out cooktop elements.

8. The method of claim 7, further comprising the steps of:

sensing, after the step of activating the one or more lockout elements to unlock the one or more cooktop elements, whether the temperature in the cooking chamber has reached at least $T_{pre}$ and, if so, then initiating a cooking cycle of the cooking chamber, and providing a signal to a user of the oven appliance that the cooking chamber temperature has reached at least $T_{pre}$.

9. The method of claim 7, wherein the step of activating a heating element comprises activating a bake heating element of the cooking chamber, and wherein the step of activating an additional heating element comprises activating a broil heating element of the cooking chamber.

10. The method of claim 7, wherein the step of activating a heating element comprises activating a bake heating element of the cooking chamber, and wherein the step of activating an additional heating element comprises activating a convection heating element of the cooking chamber.

11. The method of claim 7, wherein the step of activating a heating element comprises activating a bake heating element of the cooking chamber, and wherein the step of activating an additional heating element comprises activating both a broil and a convection heating element of the cooking chamber.

12. The method of claim 7, further comprising the steps of:

sensing, during the step of determining whether the time $t_{lock}$ has reached at least the threshold time $t_{thr}$, whether the temperature in the cooking chamber has reached at least $T_{pre}$ and, if so, then activating the one or more lockout elements to unlock the one or more locked out cooktop elements, and initiating a cooking cycle of the cooking chamber.

13. An oven range appliance, comprising:

a cabinet defining a cooking chamber configured for receipt of food items for cooking, the cooking chamber comprising a plurality of heating elements configured to heat the cooking chamber;

a cooktop having one or more cooktop elements configured for heating or cooking food items;

one or more lockout elements configured to lock out the one or more cooktop elements from a power supply; and a controller in operative communication with the heating elements of the cooking chamber, the one or more cooktop elements, and the one or more lockout elements, the controller configured for establishing a cooking chamber temperature set point $T_{pre}$ for the cooking chamber;

activating one of the plurality of heating elements;

determining whether a boost preheat mode of the cooking chamber has been chosen and, if so, then activating one or more of the lockout elements to lockout one or more of the cooktop elements;

activating an additional heating element;

sensing whether the temperature in the cooking chamber has reached at least $T_{pre}$ and, if so, then activating the one or more lockout elements to unlock to the one or more locked out cooktop elements, and initiating a cooking cycle of the cooking chamber.

14. The oven range appliance of claim 13, wherein the controller is further configured for providing a signal to a user of the oven range appliance, during the step of initiating the cooking cycle, that the cooking chamber temperature has reached at least $T_{pre}$.

15. The oven range appliance of claim 13, wherein the controller is further configured for counting a time $t_{lock}$ during the step of activating the one or more lockout elements to lockout one or more of the cooktop elements.

16. The oven range appliance of claim 15, wherein if the temperature in the cooking chamber has not reached at least $T_{pre}$, the controller is further configured for determining whether time $t_{lock}$ has reached at least a threshold time $t_{thr}$ and, if so, then activating the one or more lockout elements to unlock the one or more locked out cooktop elements.

17. The oven range appliance of claim 13, wherein the controller is further configured for executing a normal preheat algorithm if the boost preheat mode has not been chosen.

18. The oven range appliance of claim 13, wherein the additional heating element comprises a boost heating element.

19. The oven range appliance of claim 13, wherein the controller is configured to activate a bake heating element at the step of activating one of the plurality of heating elements, and wherein the controller is configured to activate one of a broil heating element and a convection heating element at the step of activating an additional heating element.

* * * * *